US012612918B2

(12) United States Patent
Kimura et al.

(10) Patent No.: US 12,612,918 B2
(45) Date of Patent: Apr. 28, 2026

(54) VACUUM PUMP

(71) Applicant: SHIMADZU CORPORATION, Kyoto (JP)

(72) Inventors: Hiroaki Kimura, Kyoto (JP); Masashi Manabe, Kyoto (JP); Takahiro Saeki, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 19/004,357

(22) Filed: Dec. 29, 2024

(65) Prior Publication Data

US 2025/0283473 A1 Sep. 11, 2025

(30) Foreign Application Priority Data

Mar. 8, 2024 (JP) ..... 2024-035673

(51) Int. Cl.
*F04D 19/04* (2006.01)
*F04D 29/00* (2006.01)
*F04D 29/58* (2006.01)

(52) U.S. Cl.
CPC ..... *F04D 19/042* (2013.01); *F04D 29/002* (2013.01); *F04D 29/5853* (2013.01); *F04D 19/048* (2013.01)

(58) Field of Classification Search
None
See application file for complete search history.

(56) References Cited

U.S. PATENT DOCUMENTS 4,832,564 A * 5/1989 Holss ..... F04D 29/542 415/199.5
5,158,426 A * 10/1992 Casaro ..... F04D 19/042 415/214.1

(Continued)

FOREIGN PATENT DOCUMENTS

CN 117570061 A 2/2024
DE 4325061 A1 * 2/2024 ..... F04D 19/042

(Continued)

OTHER PUBLICATIONS

Translation of Bader EP 4325061 (Obtained from http://translationportal.epo.org on Sep. 12, 2025) (Year: 2025).*

(Continued)

*Primary Examiner* — Bryan M Lettman
*Assistant Examiner* — Geoffrey S Lee
(74) *Attorney, Agent, or Firm* — Renner, Otto, Boisselle & Sklar, LLP

(57) ABSTRACT

To reduce deformation of a stator in an upper-lower direction. A vacuum pump includes a rotor housed in a housing and rotationally driven, plural stages of rotor blades provided in the rotor, and plural stages of stators, each of which is disposed between adjacent ones of the plural stages of rotor blades. The stator has an inner peripheral rib, an outer peripheral rib, and a stator blade connecting the inner peripheral rib and the outer peripheral rib, and is housed in the housing in a state of the outer peripheral rib being sandwiched between spacers. At least part of the outer peripheral rib of the stator is provided with a deformable portion configured to allow deformation of the inner peripheral rib and/or the stator blade in a radial direction.

6 Claims, 4 Drawing Sheets

(56) References Cited

U.S. PATENT DOCUMENTS

| | | | | |
|---|---|---|---|---|
| 6,926,493 | B1 * | 8/2005 | Miyamoto | F04D 19/042 415/177 |
| 8,961,104 | B2 * | 2/2015 | Kogame | F04D 29/522 415/220 |
| 2001/0016160 | A1 * | 8/2001 | Ikegami | F04D 27/008 415/173.1 |
| 2003/0175114 | A1 * | 9/2003 | Okudera | F04D 29/541 415/143 |
| 2009/0257889 | A1 * | 10/2009 | Shi | F04D 29/542 29/889.22 |
| 2011/0014073 | A1 * | 1/2011 | Yamaguchi | F04D 29/644 417/423.4 |
| 2021/0332824 | A1 * | 10/2021 | Yasuda | F04D 29/644 |
| 2021/0381516 | A1 * | 12/2021 | Futagi | F04D 19/042 |
| 2025/0283473 | A1 * | 9/2025 | Kimura | F04D 29/5853 |

FOREIGN PATENT DOCUMENTS

| | | | | |
|---|---|---|---|---|
| EP | 2913533 | A1 | 9/2015 | |
| JP | 2011-001825 | A | 1/2011 | |
| JP | 2021-139361 | A | 9/2021 | |
| WO | WO-2015000700 | A1 * | 1/2015 | F04D 29/542 |

OTHER PUBLICATIONS

Machine Translation of Richter WO-2015/000700 (Obtained from USPTO Search) (Year: 2025).*

Taiwanese Office Action for corresponding Application No. 113151801, issued Sep. 16, 2025, with English translation.

Taiwanese Office Action for corresponding Application No. 113151801, issued Feb. 6, 2026, with Machine Translation.

* cited by examiner

VACUUM PUMP

This application claims priority under 35 U.S.C. § 119 to Japanese Patent Application No. 2024-035673 filed on Mar. 8, 2024. The entire disclosure of Japanese Patent Application No. 2024-035673 is hereby incorporated herein by reference.

BACKGROUND OF THE INVENTION

1. Technical Field

The present invention relates to a vacuum pump.

2. Background Art

Some vacuum pumps have a rotor having rotor blades and a stator disposed between the rotor blades (see, for example, JP-A-2021-139361). In this vacuum pump, by rotating the rotor, the rotor blade moves relative to a stator blade provided in the stator. Accordingly, the vacuum pump sucks gas from the inside of a pumping target device, and discharges the sucked gas to the outside.

SUMMARY OF THE INVENTION

In the vacuum pump described above, for example, a temperature of the stator may be adjusted to a high temperature in order to reduce accumulation of a product inside the vacuum pump. In addition, even in a case where the temperature is not adjusted, the stator may have a high temperature due to high-speed rotation of the rotor or the load of gas to be discharged. In a conventional vacuum pump, there is a possibility that a stator is deformed in an upper-lower direction (i.e., direction toward a rotor blade) and comes into contact with a rotor blade due to a change in the temperature of the stator to a high temperature by, e.g., temperature adjustment. The contact of the stator with the rotor blade may cause problems such as improper operation of the vacuum pump and damage to the stator and/or the rotor blade.

Thus, an object of the present invention is to reduce deformation of a stator in a rotation axis direction and to safely operate a vacuum pump.

A vacuum pump according to one aspect of the present invention includes a rotor, plural stages of rotor blades, and plural stages of stators. The rotor is housed in a housing, and is rotationally driven. The plural stages of rotor blades are provided in the rotor. Each of the plural stages of stators is disposed between adjacent ones of the plural stages of rotor blades. Each stator has an inner peripheral rib, an outer peripheral rib, and a stator blade. The stator blade connects the inner peripheral rib and the outer peripheral rib. Each stator is housed in the housing in a state of the outer peripheral rib being sandwiched between spacers. At least part of the outer peripheral rib of the stator is provided with a deformable portion configured to allow deformation of the inner peripheral rib and/or the stator blade in a radial direction.

In the vacuum pump according to one aspect of the present invention, at least part of the outer peripheral rib of the stator is provided with the deformable portion configured to allow the deformation of the inner peripheral rib and/or the stator blade in the radial direction. Thus, even if the outer peripheral rib is sandwiched between the spacers and is difficult to be deformed in the radial direction, the inner peripheral rib and/or the stator blade are easily deformed in the radial direction. As a result, for example, in a case where there is a temperature change in the vacuum pump, the inner peripheral rib and/or the stator blade can be deformed in the radial direction, and therefore, deformation of the inner peripheral rib and/or the stator blade in a direction toward the rotor blade can be reduced. Thus, for example, even when there is the temperature change in the vacuum pump, the stator does not come into contact with the rotor blade, and the vacuum pump can be safely operated.

DETAILED DESCRIPTION OF THE EXEMPLARY EMBODIMENTS

Figure 1:
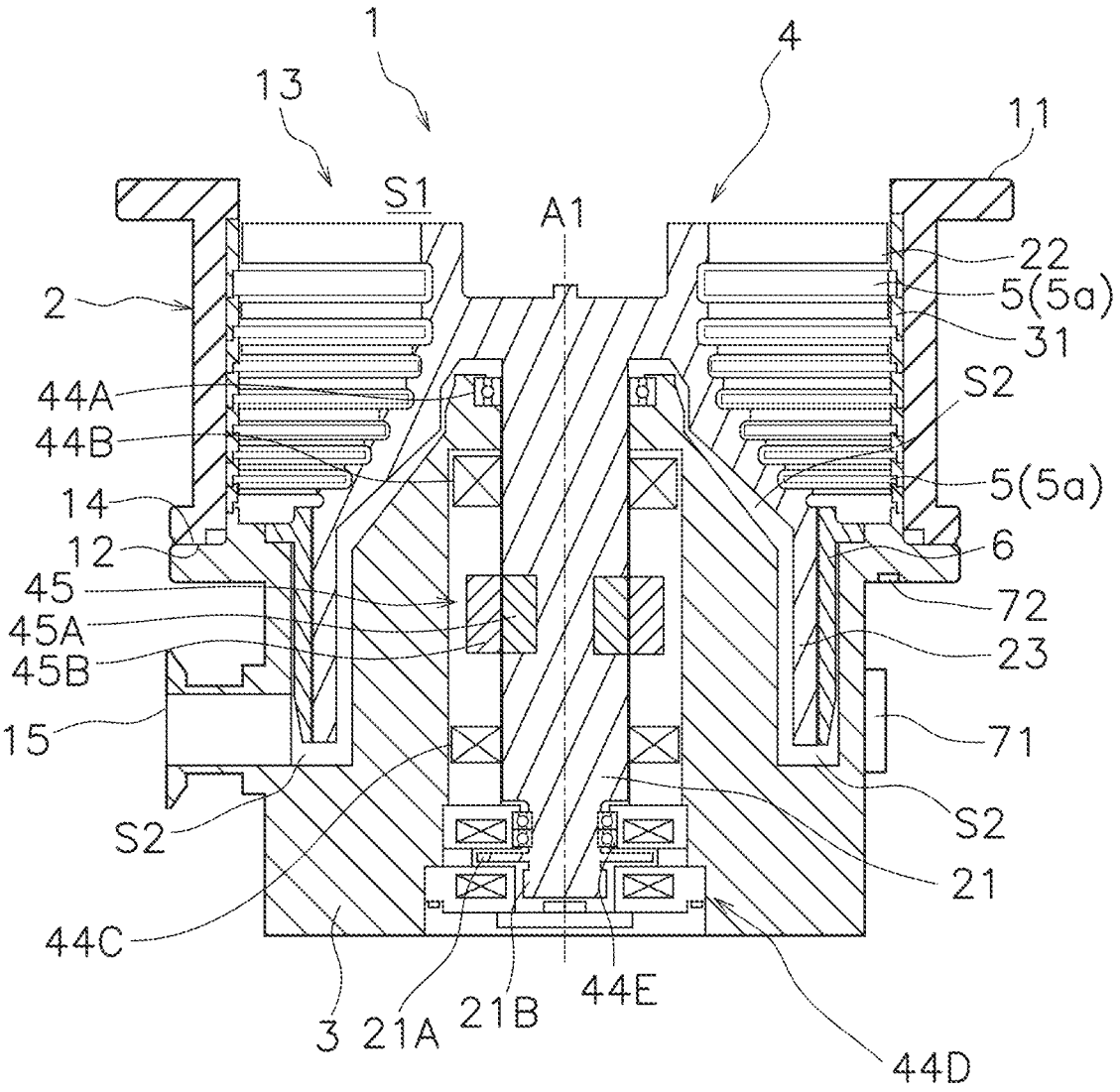
FIG. 1 is a sectional view of a vacuum pump.

Hereinafter, a vacuum pump will be described with reference to FIG. 1. FIG. 1 is a sectional view of a vacuum pump 1. The vacuum pump 1 includes a housing 2, a base 3, a rotor 4, and plural stages of stators 5.

The housing 2 includes a first end portion 11, a second end portion 12, and a first internal space S1. A suction port 13 is provided at the first end portion 11. The suction port 13 is connected to the inside of a pumping target device such that gas flows therebetween. The first internal space S1 communicates with the suction port 13. The second end portion 12 is located opposite to the first end portion 11 in the axial direction (hereinafter, simply referred to as an "axial direction A1") of the rotor 4. The second end portion 12 is connected to the base 3. The base 3 includes a base end portion 14. The base end portion 14 is connected to the second end portion 12 of the housing 2. The base 3 is, for example, a member made of aluminum.

The rotor 4 is housed in the internal space of the housing 2. The rotor 4 includes a shaft 21. The shaft 21 extends in the axial direction A1. The shaft 21 is rotatably housed in the base 3. A thrust disc 21A is provided at a lower portion of the shaft 21. A target 21B is screwed to the lower end of the shaft 21.

The rotor 4 includes plural stages of rotor blades 22 and a rotor cylindrical portion 23. Each of the plural stages of rotor blades 22 is connected to the shaft 21 with inclined with respect to the axial direction A1. The plurality of rotor blades 22 is spaced apart from each other in the axial direction A1. Although not illustrated, the plural stages of rotor blades 22 extend radially about the shaft 21. Note that in the drawing, only one of the plural stages of rotor blades 22 is denoted by a reference sign and the reference signs of the other rotor blades 22 are omitted. The rotor cylindrical portion 23 is disposed below the plural stages of rotor blades 22. The rotor cylindrical portion 23 extends in the axial direction A1.

Each of the plural stages of stators 5 is disposed on the base 3 through a spacer 31. When the housing 2 is fixed to the base 3, the stacked spacers 31 are sandwiched between the base 3 and the housing 2, and accordingly, an outer peripheral rib 53 (FIG. 2) of each stator 5 is sandwiched between the spacers 31. Thus, the plural stages of stators 5 are housed in the housing 2 in a state of being spaced apart from each other in the axial direction A1. Specifically, each stator 5 is housed in the housing 2 in a state of the outer peripheral rib of each stator 5 being sandwiched between two spacers 31. That is, the outer peripheral rib of each stator 5 is sandwiched between the two spacers 31, and therefore, adjacent two of the stators 5 are arranged at a predetermined interval in the housing 2.

Each of the plural stages of stators 5 is disposed between adjacent ones of the plural stages of rotor blades 22. Specifically, stator blades 55 (FIG. 2) of each stator 5 are arranged facing adjacent ones of the rotor blades 22.

The stator 5 has a circular shape along the internal space of the housing 2. The stator 5 includes a plurality of stator elements 5*a* obtained by dividing the circular shape. In the present embodiment, the stator 5 includes two stator elements 5*a*. That is, in the present embodiment, the stator element 5*a* has a semicircular shape. Note that the stator 5 may include two or more fan-shaped stator elements 5*a*, or may include one circular stator element 5*a*.

The vacuum pump 1 includes a screw stator 6. The screw stator 6 is fixed in contact with the base 3. The screw stator 6 is disposed facing the outer peripheral surface of the rotor cylindrical portion 23 with a slight gap in the radial direction of the rotor cylindrical portion 23. A spiral groove is provided in the inner peripheral surface of the screw stator 6 facing the rotor cylindrical portion 23.

As illustrated in FIG. 1, an exhaust space S2 is formed further downstream of exhaust-downstream-side end portions of the rotor cylindrical portion 23 and the screw stator 6. Pumping target gas discharged from the pumping target device is guided to the exhaust space S2. The exhaust space S2 communicates with an exhaust port 15. The exhaust port 15 is provided in the base 3. Another vacuum pump (not illustrated) is connected to the exhaust port 15. Note that the exhaust downstream side refers to a side closer to the exhaust space S2 in the axial direction A1. An exhaust downstream direction refers to a direction toward the exhaust space S2.

The vacuum pump 1 includes bearings 44A, 44E, magnetic bearings 44B to 44D, and a motor 45. The bearings 44A, 44E are attached to the base 3 at positions at which the shaft 21 is housed. The bearings 44A, 44E rotatably support the shaft 21. The bearings 44A, 44E are ball bearings. The magnetic bearings 44B to 44D are bearings that support the shaft 21 by magnetic force. Among these magnetic bearings, the magnetic bearings 44B, 44C are radial magnetic bearings that support the shaft 21 in the radial direction. The magnetic bearing 44D is a thrust magnetic bearing that supports the shaft 21 in the axial direction.

The motor 45 rotationally drives the rotor 4. The motor 45 includes a motor rotor 45A and a motor stator 45B. The motor rotor 45A is attached to the shaft 21. The motor stator 45B is attached to the base 3. The motor stator 45B is disposed facing the motor rotor 45A.

In the vacuum pump 1, the plural stages of rotor blades 22 and the plural stages of stators 5 (stator blades) form a turbo-molecular pump unit. The rotor cylindrical portion 23 and the screw stator 6 form a thread groove pump unit. In the vacuum pump 1, when the rotor 4 is rotated by the motor 45, the pumping target gas flows into the first internal space S1 from the inside of the pumping target device through the suction port 13. The pumping target gas in the first internal space S1 is guided to the exhaust space S2 through the turbo-molecular pump unit and the thread groove pump unit. The pumping target gas in the exhaust space S2 is discharged through the exhaust port 15. As a result, the inside of the pumping target device attached to the suction port 13 is brought into a high vacuum state.

An outer wall of the base 3 is provided with a heater 71 and a cooling water pipe for controlling the temperature of the base 3. The temperature of the base 3 is detected by a temperature sensor 72. Based on the temperature detected by the temperature sensor 72, the temperature of the base 3 is controlled by a balance between heating of the base 3 by the heater 71 and cooling with cooling water flowing through the cooling water pipe.

Figure 2:
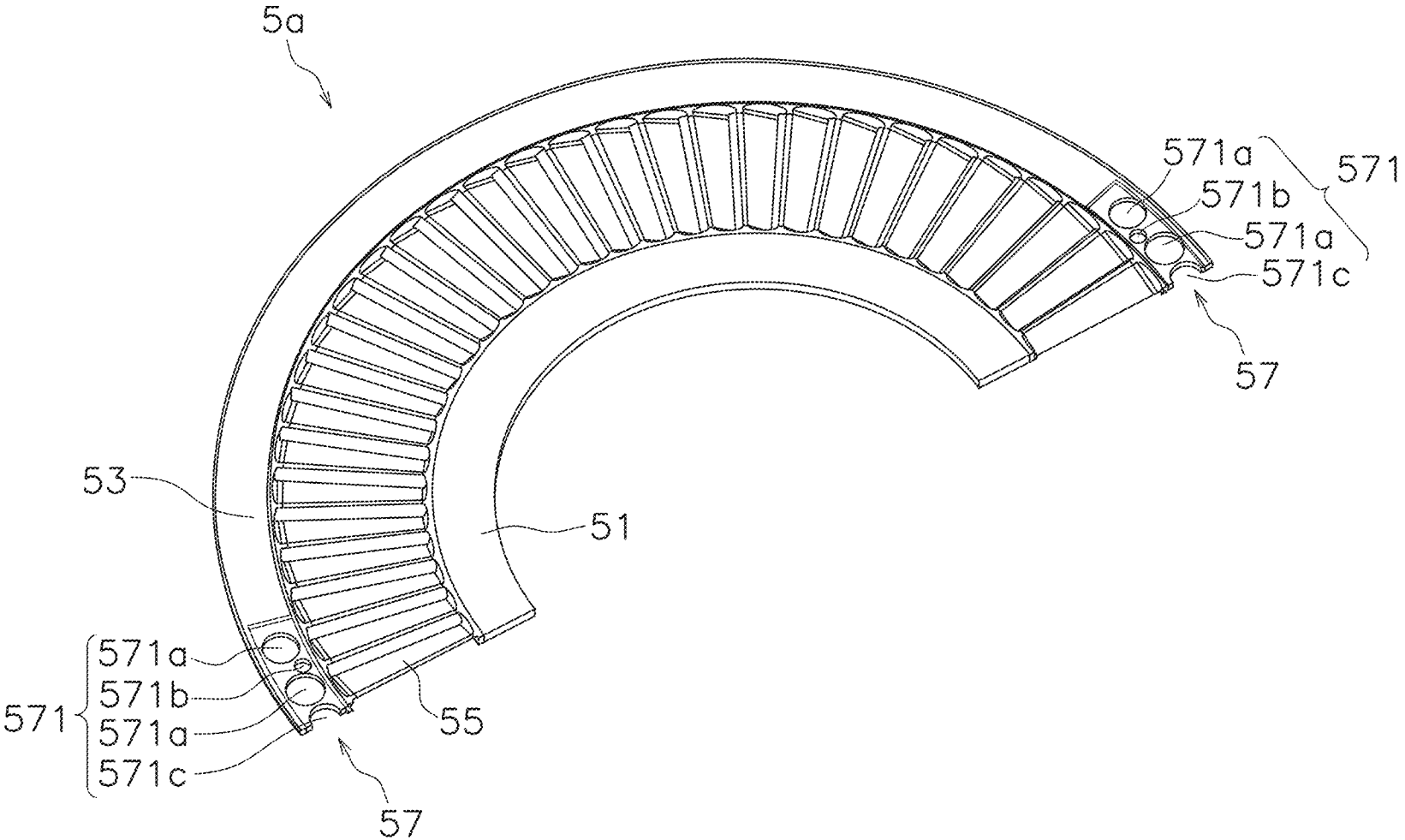
FIG. 2 is a view of the entirety of a stator element.

Hereinafter, a specific configuration of the stator 5 (stator element 5*a*) will be described with reference to FIG. 2. FIG. 2 is a view of the entirety of the stator element 5*a*. The stator 5 of each stage is formed by joining the plurality of stator elements 5*a*. In general, the circular ring-shaped stator 5 is formed by joining two stator elements 5*a* divided at 180 degrees as illustrated in FIG. 2 (in FIG. 2, only one of the two stator elements is illustrated). The stator element 5*a* has an inner peripheral rib 51, the outer peripheral rib 53, and the plurality of stator blades 55.

The inner peripheral rib 51 forms the inner periphery of the stator 5. The rotor 4 is disposed in a space on the inner peripheral side of the inner peripheral rib 51. That is, the inner peripheral diameter of the inner peripheral rib 51 is greater than the diameter of the rotor 4. The outer peripheral rib 53 is disposed apart from the inner peripheral rib 51 by a predetermined distance in the radial direction, and forms the outer periphery of the stator 5.

The stator blades 55 are provided so as to connect the inner peripheral rib 51 and the outer peripheral rib 53. The stator blades 55 extend radially about the shaft 21. The stator blade 55 is inclined in a direction opposite to the inclination of the rotor blade 22. For example, in a case where the rotor blade 22 is inclined from a suction side to an exhaust side, the stator blade 55 is inclined from the exhaust side to the suction side. On the other hand, in a case where the rotor blade 22 is inclined from the exhaust side to the suction side, the stator blade 55 is inclined from the suction side to the exhaust side. The inclination directions of the rotor blade 22 and the stator blade 55 can be appropriately determined according to, e.g., the rotation direction of the rotor 4.

In the vacuum pump 1, a predetermined product is generated from a raw material having flowed in from the pumping target device, and there is a possibility that the product is accumulated inside the vacuum pump 1. In order to reduce such accumulation, the temperature of the vacuum pump 1 is adjusted using the heater 71 and/or the cooling water pipe of the vacuum pump 1. When the temperature of the vacuum pump 1 changes due to this temperature adjustment, the inner peripheral rib 51 and/or the stator blade 55 of the stator 5 may be deformed in an upper-lower direction (direction toward the rotor blade 22). If such deformation is excessive, the stator blade 55 may come into contact with the rotor blade 22.

The present inventor(s) has found that the inner peripheral rib 51 and/or the stator blade 55 are greatly deformed in the upper-lower direction when the temperature of the vacuum pump 1 changes due to the fact that the outer peripheral rib 53 cannot be deformed in the plane of the stator 5 (i.e., in the radial direction of the stator 5) because the outer peripheral rib 53 is sandwiched between the spacers 31. Based on this finding, the present inventor(s) has found that by providing a deformable portion 57 described below in the outer peripheral rib 53, the outer peripheral rib 53 is deformed in the radial direction of the stator 5, and by deforming the inner peripheral rib 51 and/or the stator blade 55 in the radial direction according to such deformation, deformation of the inner peripheral rib 51 and/or the stator blade 55 in the upper-lower direction can be reduced.

Figure 3:
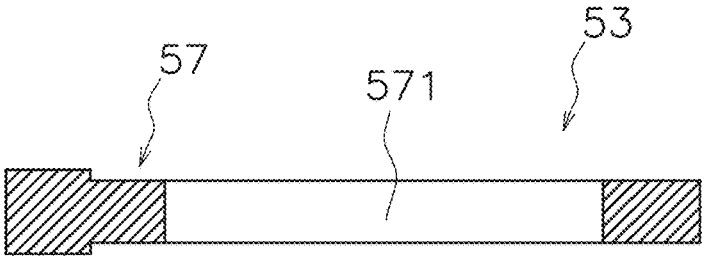
FIG. 3 is a sectional view of a portion of the stator element provided with a deformable portion.

As illustrated in FIG. 2, the deformable portion 57 is provided at an end portion of the outer peripheral rib 53 in the circumferential direction of the stator element 5*a*. Preferably, the deformable portion 57 is provided at each end portion of the outer peripheral rib 53 in the circumferential direction of the stator element 5*a*. That is, the deformable portion 57 is provided in an area of a predetermined length in the circumferential direction starting from the end portion of the outer peripheral rib 53 in the circumferential direction of the stator element 5*a*. Although not particularly limited, the predetermined length in the circumferential direction substantially corresponds to two to three stator blades 55. As illustrated in FIGS. 2 and 3, the deformable portion 57 is provided with a plurality of through-holes 571 penetrating the outer peripheral rib 53 in the thickness direction thereof. Specifically, the deformable portion 57 is provided with two large circular through-holes 571*a*, a small circular through-hole 571*b* located between the two large circular through-holes 571*a*, and one semicircular through-hole 571*c* provided at an end portion of the outer peripheral rib 53. FIG. 3 is a sectional view of a portion of the stator element 5*a* provided with the deformable portion 57.

As illustrated in FIGS. 2 and 3, the through-hole 571 forms a space in the plane of the outer peripheral rib 53 (i.e., in a plane including the radial direction of the stator 5). With this configuration, even when the outer peripheral rib 53 is sandwiched between the spacers 31, the through-hole 571 is deformed in the plane of the outer peripheral rib 53 due to, e.g., the temperature change, and the inner peripheral rib 51 and/or the stator blade 55 can be deformed in the radial direction of the stator 5 accordingly. Since the inner peripheral rib 51 and/or the stator blade 55 can be deformed in the radial direction, the deformation of the inner peripheral rib 51 and/or the stator blade 55 in the upper-lower direction (direction toward the rotor blade 22) is reduced.

By providing the semicircular through-holes 571*c* at both end portions of the outer peripheral rib 53, the semicircular through-holes 571*c* can be deformed more greatly. This is because the end portion of the outer peripheral rib 53 of the stator element 5*a* is a connection portion with another stator element 5*a*, and there is a gap at this portion. As a result, the inner peripheral rib 51 and/or the stator blade 55 can be deformed more greatly in the radial direction, and therefore, the deformation of the inner peripheral rib 51 and/or the stator blade 55 in the upper-lower direction is further reduced.

As illustrated in FIGS. 2 and 3, the deformable portion 57 has a smaller thickness than those of the other portions of the outer peripheral rib 53. That is, as illustrated in FIG. 2, the deformable portion 57 is formed with a smaller thickness in a belt shape in the circumferential direction starting from the end portion of the outer peripheral rib 53 in the circumferential direction. The plurality of through-holes 571 is provided within this belt-shaped area with a smaller thickness. Accordingly, when the outer peripheral rib 53 is sandwiched between the two spacers 31, a gap is formed between the spacer 31 and the deformable portion 57. By forming the gap between the spacer 31 and the deformable portion 57, the deformable portion 57 is easily deformed in the plane of the outer peripheral rib 53, so that the inner peripheral rib 51 and/or the stator blade 55 can also be easily deformed in the radial direction.

In the vacuum pump 1 described above, at least part of the outer peripheral rib 53 of the stator 5 is provided with the deformable portion 57 allowing the deformation of the inner peripheral rib 51 and/or the stator blade 55 in the radial direction. Thus, even if the outer peripheral rib 53 is sandwiched between the spacers and is difficult to be deformed in the radial direction, the inner peripheral rib 51 and/or the stator blade 55 are easily deformed in the radial direction. As a result, for example, in a case where there is a temperature change in the vacuum pump 1, the inner peripheral rib 51 and/or the stator blade 55 can be deformed in the radial direction, and therefore, the deformation of the inner peripheral rib 51 and/or the stator blade 55 in the direction toward the rotor blade 22 can be reduced. Thus, for example, even when there is the temperature change in the vacuum pump 1, the stator 5 does not come into contact with the rotor blade 22, and the vacuum pump 1 can be safely operated. In particular, by providing the deformable portions 57 at both end portions of the outer peripheral rib 53 in the circumferential direction of the stator element 5*a*, the effect of reducing the deformation of the inner peripheral rib 51 and/or the stator blade 55 in the direction toward the rotor blade 22 becomes more remarkable as compared to a case where the deformable portion 57 is provided at a center portion of the outer peripheral rib 53 in the circumferential direction of the stator element 5*a*.

Although one embodiment of the present invention has been described above, the present invention is not limited to the above embodiment, and various changes can be made without departing from the gist of the invention.

Figure 4:
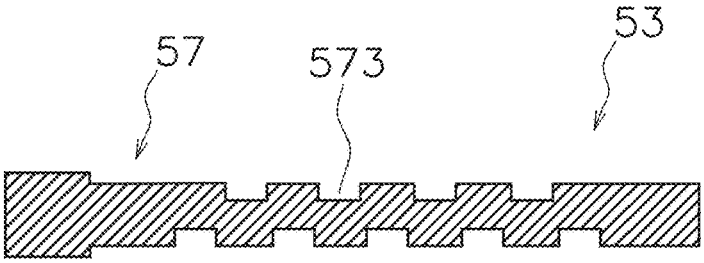
FIG. 4 is a sectional view of the deformable portion provided with a groove.

In the vacuum pump 1 according to the above embodiment, the outer peripheral rib 53 is easily deformed in the radial direction (in the plane of the stator 5) by providing the through-hole 571 in the deformable portion 57 of the outer peripheral rib 53. The through-hole 571 can be formed by an easy process of forming a hole in the outer peripheral rib 53. However, the configuration facilitating the deformation of the outer peripheral rib 53 is not limited to the through-hole 571. For example, as illustrated in FIG. 4, the outer peripheral rib 53 can also be easily deformed by providing a groove 573 not penetrating the outer peripheral rib 53 in the deformable portion 57. Since the groove 573 can be formed without penetrating the outer peripheral rib 53, the groove 573 can be formed by an easy process. FIG. 4 is a sectional view of the deformable portion 57 provided with the groove 573.

Figure 5:
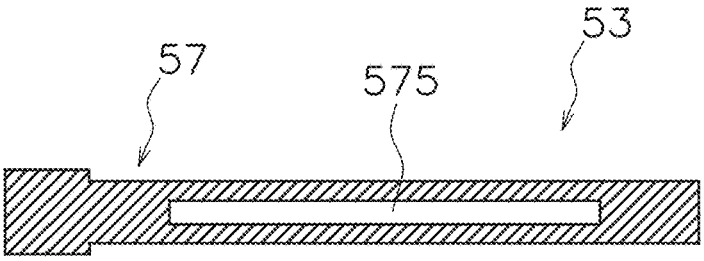
FIG. 5 is a sectional view of the deformable portion provided with a hollow.

In addition, for example, as illustrated in FIG. 5, the outer peripheral rib 53 can also be easily deformed by providing a hollow 575, which is a space inside the outer peripheral rib 53, in the deformable portion 57. The stator 5 configured such that the hollow 575 is provided in the outer peripheral rib 53 can be formed using, for example, a 3D printer. Since the hollow 575 is not visible from the outside of the stator 5, the appearance of the stator 5 can be improved. FIG. 5 is a sectional view of the deformable portion 57 provided with the hollow 575.

Figure 6:
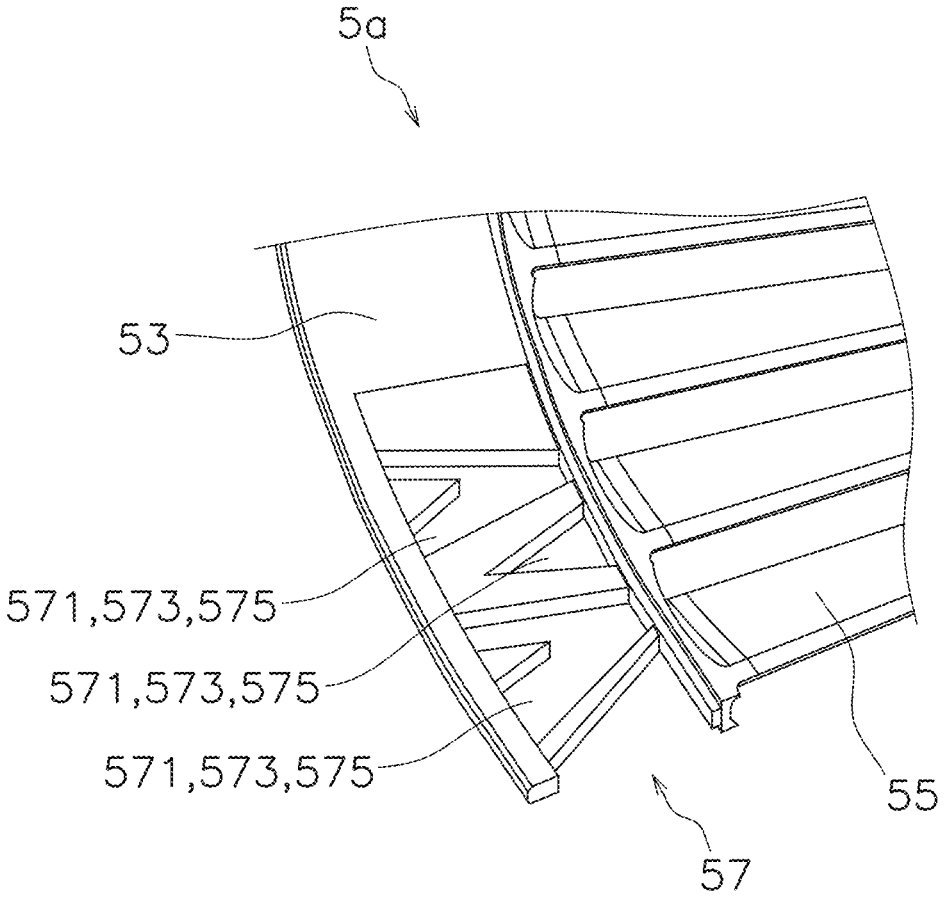
FIG. 6 is a view illustrating an example of the through-hole, the groove, and the hollow in shapes other than a circular shape.

The through-hole 571, the groove 573, and the hollow 575 formed in the deformable portion 57 may have arbitrary shapes other than a circular shape. The through-hole 571, the groove 573, and the hollow 575 can be formed by alternately arranging V-shaped portions and triangular portions as illustrated in FIG. 6, for example. FIG. 6 is a view illustrating an example of the through-hole 571, the groove 573, and the hollow 575 in shapes other than a circular shape.

The deformable portion 57 can be located at an arbitrary position in the outer peripheral rib 53 as long as the deformable portion 57 is formed at least in part of the outer peripheral rib 53. For example, the plurality of deformable portions 57 may be located at equal intervals along the circumferential direction of the outer peripheral rib 53.

The deformable portion 57 may be formed in combination with the through-hole 571, the groove 573, and/or the hollow 575 in arbitrary shapes.

The vacuum pump 1 according to the above embodiment is the pump in which the turbo-molecular pump unit formed by the plural stages of rotor blades 22 and the plural stages of stators 5 and the thread groove pump unit formed by the rotor cylindrical portion 23 and the screw stator 6 are integrated. However, the thread groove pump may be omitted. That is, the stator 5 having the deformable portion 57 can also be applied to a vacuum pump including only a turbo-molecular pump.

It is understood by those skilled in the art that the plurality of exemplary embodiments described above are specific examples of the following aspects.

(First Aspect) A vacuum pump (for example, vacuum pump 1) according to a first aspect includes a rotor (for example, rotor 4), plural stages of rotor blades (for example, rotor blades 22), and plural stages of stators (for example, stators 5). The rotor is housed in a housing (for example, housing 2), and is rotationally driven. The plural stages of rotor blades are provided in the rotor. Each of the plural stages of stators is disposed between adjacent ones of the plural stages of rotor blades. Each stator has an inner peripheral rib (for example, inner peripheral rib 51), an outer peripheral rib (for example, outer peripheral rib 53), and a stator blade (for example, stator blade 55). The stator blade connects the inner peripheral rib and the outer peripheral rib. Each stator is housed in the housing in a state of the outer peripheral rib being sandwiched between spacers (for example, spacers 31). At least part of the outer peripheral rib of the stator is provided with a deformable portion (for example, deformable portion 57) configured to allow deformation of the inner peripheral rib and/or the stator blade in the radial direction.

In the vacuum pump according to the first aspect, at least part of the outer peripheral rib of the stator provided with the deformable portion allowing the deformation of the inner peripheral rib and/or the stator blade in the radial direction. Thus, even if the outer peripheral rib is sandwiched between the spacers and is difficult to be deformed in the radial direction, the inner peripheral rib and/or the stator blade are easily deformed in the radial direction. As a result, for example, in a case where there is a temperature change in the vacuum pump, the inner peripheral rib and/or the stator blade can be deformed in the radial direction, and therefore, deformation of the inner peripheral rib and/or the stator blade in a direction toward the rotor blade can be reduced. Thus, for example, even when there is the temperature change in the vacuum pump, the stator does not come into contact with the rotor blade, and the vacuum pump can be safely operated.

(Second Aspect) In the vacuum pump according to the first aspect, the stator of each stage may include a plurality of stator elements (for example, stator elements 5*a*). In this case, the deformable portion may be formed at an end portion of the outer peripheral rib in the circumferential direction of the stator element. The end portion of the outer peripheral rib in the circumferential direction of the stator element is a connection portion with another stator element, and there is a gap at this portion. As a result, the inner peripheral rib and/or the stator blade can be deformed more greatly in the radial direction, and therefore, deformation of the inner peripheral rib and/or the stator blade in the upper-lower direction is further reduced.

(Third Aspect) In the vacuum pump according to the first aspect or the second aspect, the deformable portion may have a smaller thickness than those of the other portions of the outer peripheral rib. In the vacuum pump according to the third aspect, when the outer peripheral rib is sandwiched between the spacers, a gap is formed between the spacer and the deformable portion, and therefore, the deformable portion is easily deformed in the plane of the outer peripheral rib. As a result, the inner peripheral rib and/or the stator blade are also easily deformed in the radial direction.

(Fourth Aspect) In the vacuum pump according to any one of the first to third aspects, the deformable portion may have a through-hole (for example, through-hole 571) penetrating the outer peripheral rib. In the vacuum pump according to the fourth aspect, the through-hole can be formed by an easy process of forming a hole in the outer peripheral rib, and therefore, the stator can be easily processed.

(Fifth Aspect) In the vacuum pump according to any one of the first to fourth aspects, the deformable portion may have a hollow (for example, hollow 575) formed inside the outer peripheral rib. In the vacuum pump according to the fifth aspect, the hollow is not visible from the outside of the stator, and therefore, the appearance of the stator can be improved.

(Sixth Aspect) In the vacuum pump according to any one of the first to fifth aspects, the deformable portion may have a groove (for example, groove 573) formed in the outer peripheral rib. In the vacuum pump according to the sixth aspect, the groove can be formed by an easy process, and therefore, the stator can be easily processed.

What is claimed is:

1. A vacuum pump comprising:

a rotor housed in a housing and rotationally driven;

plural stages of rotor blades provided in the rotor; and plural stages of stators, each of which is disposed between adjacent ones of the plural stages of rotor blades, wherein each stator includes an inner peripheral rib, an outer peripheral rib, and a stator blade connecting the inner peripheral rib and the outer peripheral rib, and is housed in the housing in a state of the outer peripheral rib being sandwiched between spacers, and at least part of the outer peripheral rib is provided with a deformable portion configured to allow, in a state where the outer peripheral rib is sandwiched between the spacers, deformation of the inner peripheral rib and/or the stator blade in a radial direction due to a temperature change of the stator to reduce deformation of the inner peripheral rib and/or the stator blade in a rotation axis direction due to the temperature change of the stator.

2. The vacuum pump according to claim 1, wherein the stator of each stage includes a plurality of stator elements, and the deformable portion is formed at an end portion of an outer peripheral rib of each stator element in a circumferential direction thereof.

3. The vacuum pump according to claim 1, wherein the deformable portion has a smaller thickness than those of other portions of the outer peripheral rib.

4. The vacuum pump according to claim 1, wherein the deformable portion has a through-hole penetrating the outer peripheral rib.

5. The vacuum pump according to claim 1, wherein the deformable portion has a hollow formed inside the outer peripheral rib.

6. The vacuum pump according to claim 1, wherein the deformable portion has a groove formed in the outer peripheral rib.

* * * * *